United States Patent [19]

Jacobsen et al.

[11] Patent Number: 4,827,991

[45] Date of Patent: May 9, 1989

[54] TWIST TIE FEED DEVICE

[75] Inventors: Thomas Jacobsen, Midland Park; Alexander L. Parker, Tenafly, both of N.J.

[73] Assignee: Ben Clements & Sons, Inc., South Hackensack, N.J.

[21] Appl. No.: 924,076

[22] Filed: Oct. 28, 1986

[51] Int. Cl.[4] ..... B21F 9/02

[52] U.S. Cl. ..... 140/93.6; 100/32

[58] Field of Search ..... 140/93 A, 93.6; 100/26, 100/32

[56] References Cited

U.S. PATENT DOCUMENTS 3,518,807 7/1970 Pitkanen ..... 140/93.6

4,177,724 12/1979 Johnson et al. ..... 100/32

4,508,030 4/1985 Grenon ..... 100/26

4,559,977 12/1985 Dilley ..... 140/93.6

*Primary Examiner*—Lowell A. Larson

*Attorney, Agent, or Firm*—Blum Kaplan

[57] ABSTRACT

In a machine for twist tying a bundle of product, the tie ribbon is fed, for looping about the product to a twist head, by a feed roller. The leading end of the tie ribbon is then clamped to the twist head by a first gripper and, rearward of the feed roller, by a staking clamp and the feed roller is allowed to free wheel. The tie ribbon in the path between the feed roller and the staking clamp is then displaced laterally out of the path. The tension in the tie ribbon around the bundle is controlled by regulating the force applied in displacing the tie ribbon. While the tie ribbon is being tightened on the bundle, tie ribbon needed for looping about the next bundle is placed in an accumulator.

19 Claims, 5 Drawing Sheets

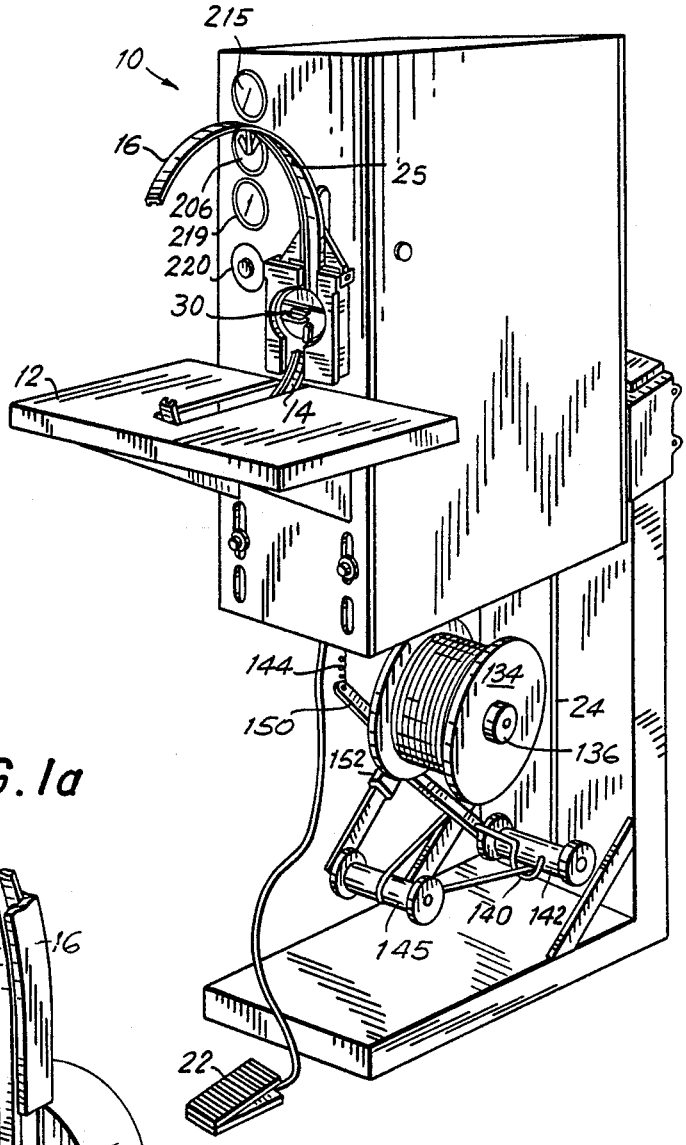
FIG. 1
FIG. 1a
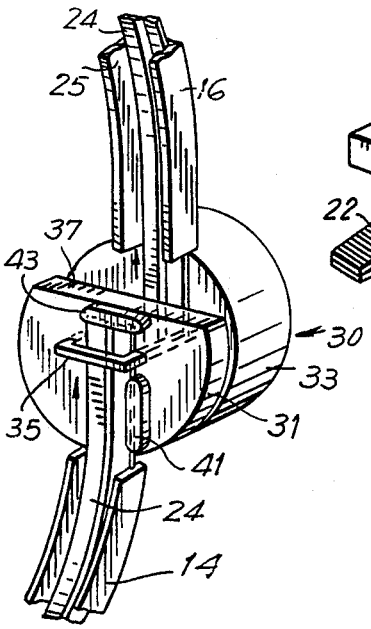

TWIST TIE FEED DEVICE

This invention relates to a tying machine for use in tying together a bundle of items of produce and the like. More particularly, the invention relates to a device for feeding a tie wire to the looping portion of a twist tying machine and for withdrawing the tie wire to tighten it into a snug, twisted loop about the bundle.

It is known in the prior art, and particularly, in U.S. Pat. No. 4,559,977, issued Dec. 24, 1985, to feed a loop of tie ribbon, in the form of a malleable wire which is glued between two strips of paper, about a bundle of produce, such as asparagus, etc., and to then tighten the wire together about the bundle preparatory to twisting the ribbon to fasten it to the bundle. To this end, the twist tying machine of the aforementioned patent utilizes a head assembly in which a first and a second gripper clamp the ends of the tie ribbon on a twister head after it has been tightened about the bundle. The twister head is then rotated so that the grippers are spun about each other, then to twist the tie ribbon.

In the foregoing patent, the first step is to loop the tie ribbon about the bundle; to this end, tie ribbon is withdrawn from a supply spool by a ribbon feed wheel. The leading end of the tie ribbon is guided about the bundle which is to be tied by a ring and when the end reaches the twister head, it is clamped by the first gripper. The feed wheel then reverses, withdrawing excess ribbon and tightening the ribbon about the bundle. In the known device, the level of tension produced in the tie ribbon is determined by a friction clutch in the feed wheel drive which limits the application of excess tension to the bundle of produce. When the tie ribbon is under tension, the second gripper clamps the uncut ribbon to the twister head. The twister head is driven in rotation and the tie ribbon is cut. After enough rotation to provide a positive twist, the grippers are released, permitting removal of the tied bundle from the machine.

It has been found, in practice, that, while serviceable, the range of pressure adjustment of the feed mechanism of the known machine was limited by the need to forcibly withdraw tie ribbon from the supply spool, while feeding it to the twist head and by the tension applied to the loop as it was being tightened around the bundle, with the result that the tie ribbon was often so damaged that flaking of the ribbon resulted. It is desirable, therefore, to provide a mechanism for feeding and for withdrawing the fed tie ribbon in which a wide range of tension adjustment is made available and which, at the same time, does not abrade the tie ribbon.

SUMMARY OF THE INVENTION

In the apparatus of the invention, the product to be tied is placed within a guide ring, and encircled by a tie ribbon which is guided by the ring. Upon formation of a loop about the product, the leading end of the tie ribbon is gripped by a clamp and the ribbon is pulled back into the machine until a desired tension is reached. The ribbon is then twisted and cut. In the tie ribbon feed mechanism of the invention, the ribbon is fed forward into the guide ring by rotation of two feed wheels, the pressure between which is adjustable to grip the ribbon lightly when the ribbon is being fed. To feed the ribbon, the wheels are driven by a rack and pinion mechanism. When the leading end of the tie ribbon has been gripped in the twister head, the pressure on the drive wheels is released, freeing the ribbon to be pulled back in the opposite direction by a pull-back mechanism. The pull-back mechanism includes a tensioning system which is independent of the feed wheels and which provides a wide range of adjustment of the degree of tension which is applied to the ribbon.

The tensioning mechanism includes a clamp which is located at a point between the feed wheels and the source of the tie ribbon. The portion of the ribbon which lies on the path between the clamp and the feed wheels is contacted by a roller which is then moved to one side of the path by a lever arm on which the roller is carried. The lever arm is driven by a cylinder to which air is supplied under pressure and the level of the pressure establishes the tension applied to the tie ribbon. At the same time, a new supply of ribbon is withdrawn from the supply reel and accumulated in a loop between the clamp and the supply reel, where it is held available for the next ribbon feed operation. For this purpose, the supply operation utilizes another roller which is carried on another lever arm which is driven similarly to that employed in the ribbon tensioning operation. As the result of the foregoing provisions, minimum pressure can be applied to the feed wheel for feeding the tie ribbon, and, then, only for feeding, thereby minimizing damage or wear of the tie ribbon.

The tightness of the tie ribbon loop about the product is controlled by regulating the air pressure applied to the tensioning cylinder which drives the tensioning roller in withdrawal of the loop. By appropriate regulation of the air pressure applied to the tensioning cylinder, the application of high tension to the ribbon which could cause it to break at the twist, is avoided.

To avoid friction damage to the ribbon, the ribbon feed pressure is kept to the minimum required to insure that the ribbon completes the circuit of the ring in the initial ribbon feeding step.

It is an object, therefore, of the present invention to provide an apparatus for feeding tie ribbon into a loop about a product and for subsequently applying tension to the loop to tighten the loop around the product.

It is another object of the invention to provide an apparatus for looping and tightening tie ribbon around a product without damaging the tie ribbon.

It is a further object of the invention to provide an apparatus for applying tension to a loop of tie ribbon about a product while avoiding damage to the product.

It is still another object of the invention to provide an apparatus for controlling the tightness of the tie ribbon around the product to avoid breaking the tie ribbon during twisting.

An additional object of the invention is to minimize the pressure which must be applied during feeding of a tie ribbon into a loop.

Still other objects and advantages of the invention will in part be obvious and will in part be apparent from the specification.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

BRIEF DESCRIPTION OF THE DRAWINGS

For a fuller understanding of the invention, reference is had to the following description, taken in connection with the accompanying drawings, in which:

FIG. 1 is a perspective view of a twist tying machine in accordance with the teachings of the invention;

FIG. 1*a* is a perspective view of the twist head used in the twist tying machine of FIG. 1;

DETAILED DESCRIPTION OF THE INVENTION

Figure 2:
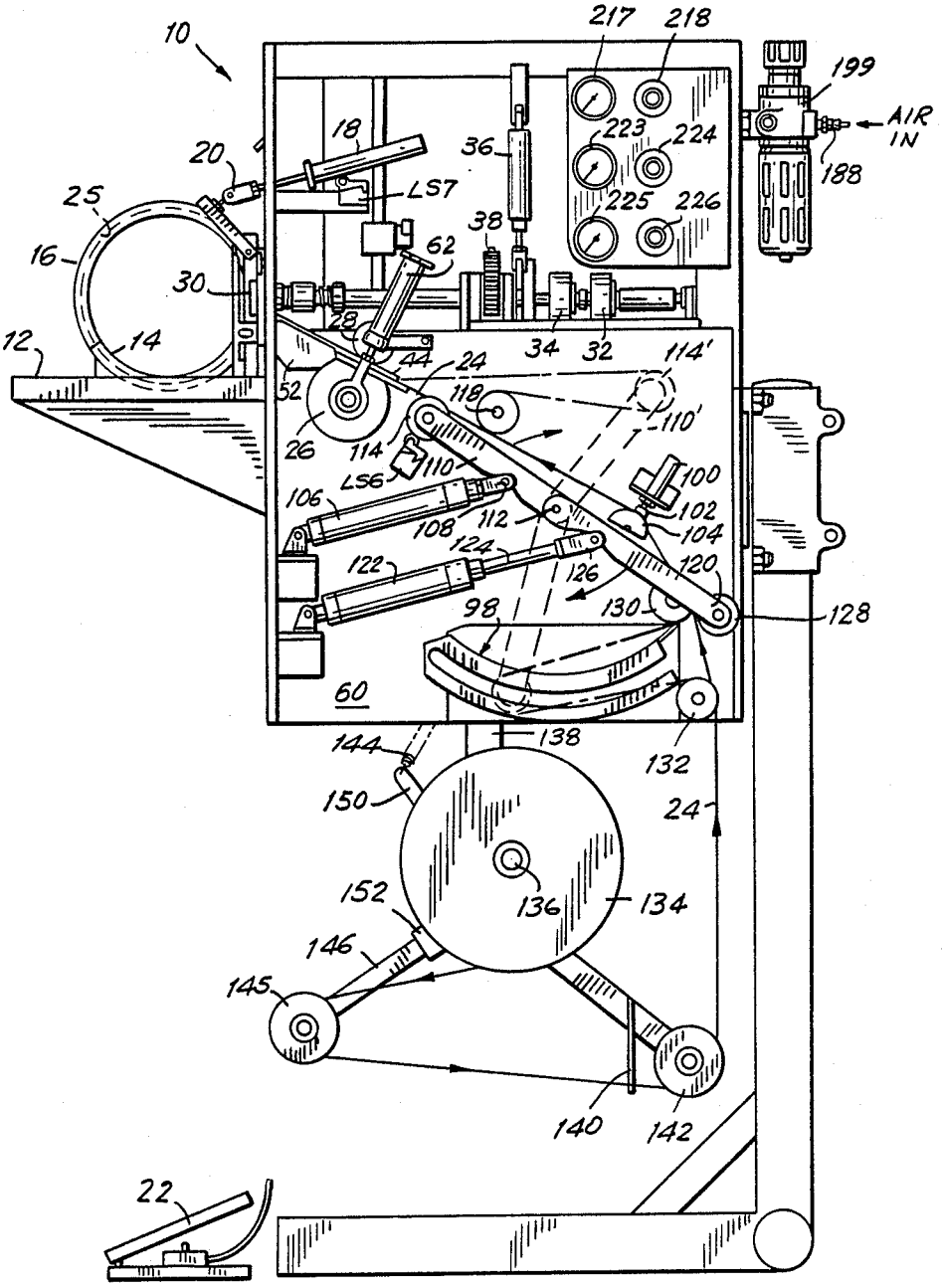
FIG. 2 is an elevational view from one side of the twist tying machine of FIG. 1.

A twist tying machine 10 which embodies the teachings of the invention is shown in the perspective view of FIG. 1. As is set forth in detail in the above cited U.S. Pat. No. 4,559,977, which is specifically incorporated herein by reference, a bundle (not shown) of product, such as asparagus, a rolled newspaper, etc. is positioned on a work table 12 in a position to be encircled from below and above by tie ribbon guide rings 14 and 16, respectively. Upper guide ring 16 can be lowered from the open position of FIG. 1 to the closed position of FIGS. 2 and 3 by means of pneumatically-actuated cylinder 18 and linkage 20, under control of a foot pedal 22 of the pneumatic control circuit of FIG. 5, as will be explained in detail below.

The closure of upper guide ring segment 16 on lower guide ring segment 14, both of which have interconnecting U-shaped inwardly-facing grooves which form a guide channel 25, provides a single-turn, helical path along which the leading end of a tie ribbon 24 (FIG. 2) is fed by the combined operation of feed wheels 26 and 28. When a complete loop of tie ribbon has been formed, a first gripper 31 in twister head 30, is actuated to clamp the leading end of the ribbon after it exits from guide ring groove 25, onto twist head plate 33. A second gripper 35 clamps the as yet uncut end of the tie ribbon after tension is applied.

Arrow 37 shows the path of the tie ribbon as it is fed upward between second gripper 31 and twist head plate 33, into groove 25 in upper ring segment 16. Arrow 39 shows the path of the tie ribbon as it is returned by lower ring segment 14 so that the returning tie ribbon encounters the front surface of second gripper 31, where it contacts a guide 41 which ensures that it travels into the arch of U-shaped first gripper 35. After passing through the arch of first gripper 35, the tie ribbon bumps into a stop 43, which is fastened to the front surface of second gripper 31 and lies generally parallel to first gripper 35.

In operation, the U-shaped portion of first gripper 35 is moved against the front surface of second gripper 31 so as to clamp the lead end of the tie ribbon. Then, after the tie ribbon has been tensioned, as will be described below, the second gripper head and the first gripper head are moved together toward twist head plate 33 so that the second portion of the tie ribbon is clamped between second gripper 31 and twist head plate 33. Actuation of a locking cylinder 36 releases twist head assembly 30 for rotation, and a pinion 38 turns the twist head assembly for approximately two revolutions. Pinion 38 is engaged by a rack 39 (FIG. 3) and is turned thereby when the rack is driven by a twister head drive cylinder 40 (FIG. 3) under control of the pneumatic control circuit of FIG. 5. With the exception of tie ribbon stop 43, the structure of the twist head assembly is like that set forth in the aforementioned U.S. Pat. No. 4,559,977, and along with detail of the ring segments and the ring actuator, is described here only in sufficient detail to illustrate the principles and operation of the present invention.

The tie ribbon feed mechanism of the invention will now be described in detail in connection with FIGS. 2, 3, and 4, but, in particular, in connection with FIG. 4. Tie ribbon 24 is fed into guide channel 25 of upper and lower guide ring segments 16 and 14 (FIGS. 2 and 3), respectively, by means of a driven feed wheel 26 and an idler feed wheel 28. Tie ribbon 24 comprises a malleable wire 42 which is glued between a pair of thin paper or plastic tapes as shown in cross section in FIG. 4. Other forms of suitable tape may, of course, be used. For guidance in its passage between the feed wheels, tie ribbon 24 passes through a chute 44. Chute 44 has a shallow tie ribbon channel 46, which is formed as a groove in the lower surface of upper chute plate 48 (FIG. 4). The bottom of the channel is the upper surface of lower chute plate 50. As depicted in FIG. 2, chute 44 is supported on the base or frame panel 60 of the machine by a chute mounting block 52.

Idler feed wheel 28 (FIG. 4), which has a polyurethane tire 29, rotates on an axle 54 which is supported in a clevis 58. Clevis 58, in turn, is pivotably supported on frame 60 by means of pivot pin 59. Also supported on idler wheel axle 54 is a ribbon feed pressure cylinder 62 from which a connecting rod 64 extends downward to engage a lower feed wheel drive axle 78. Driven feed wheel 26 is a hardened one piece wheel, which comprises a disk 82 and a hardened surface 80, is fastened to and turns with lower feed wheel drive axle 78. Axle 78 is journaled in frame panel 60 and is driven, on the other side thereof, by a sprocket 84. When energized by air via tubing 86 from the pneumatic control circuit of FIG. 5, ribbon feed pressure cylinder 62 pushes on connecting rod 64, moving axle 54 and idler wheel 28 toward axle 78 of lower feed wheel 26 and putting pressure on tie ribbon 24. The timing and the amount of pressure which is applied to tie ribbon 24 during feeding is completely controlled by means of the air signal which is sent to ribbon feed pressure cylinder 62.

Figure 3:
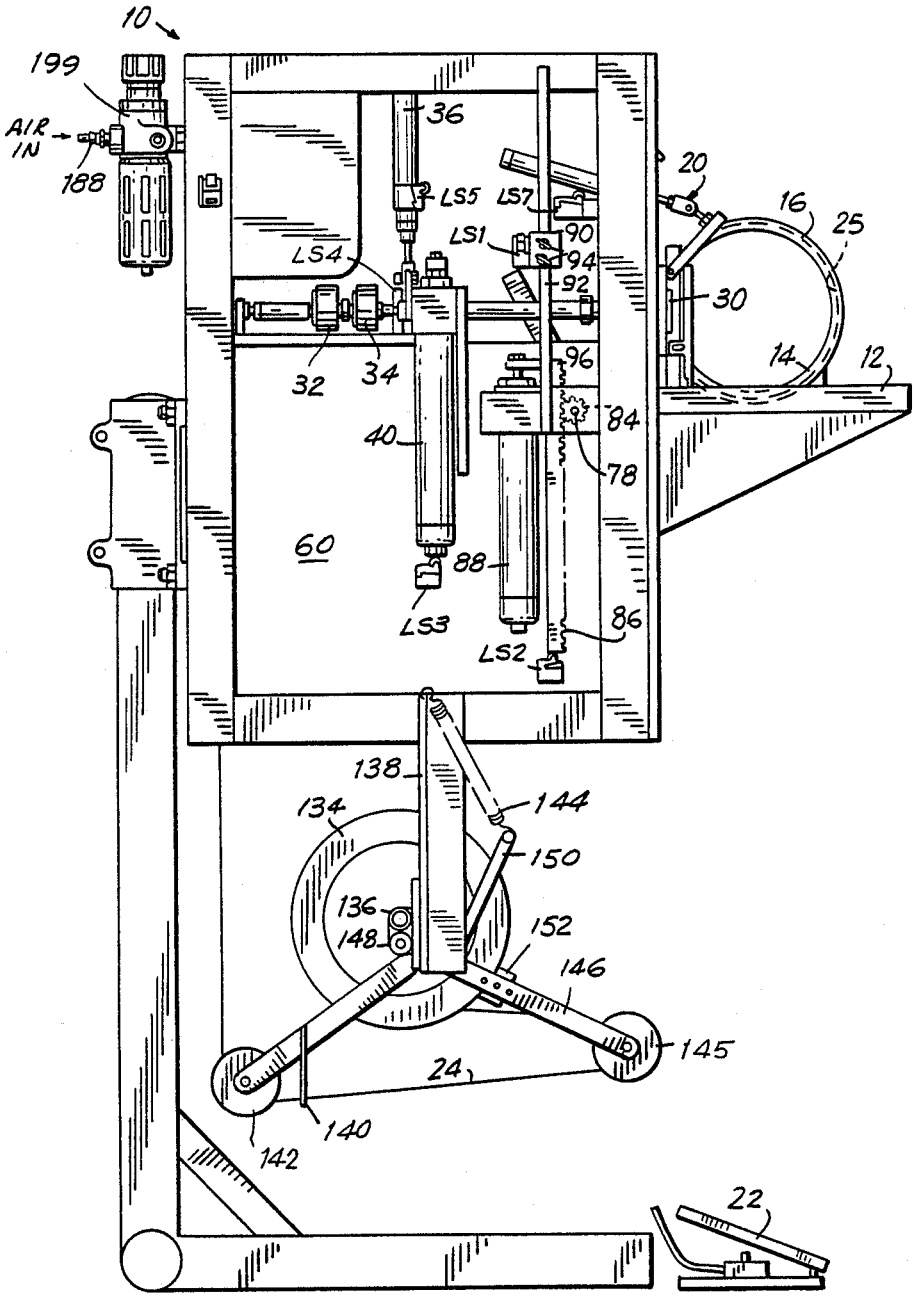
FIG. 3 is an elevational view from the other side of the twist tying machine of FIG. 1.
Figure 4:
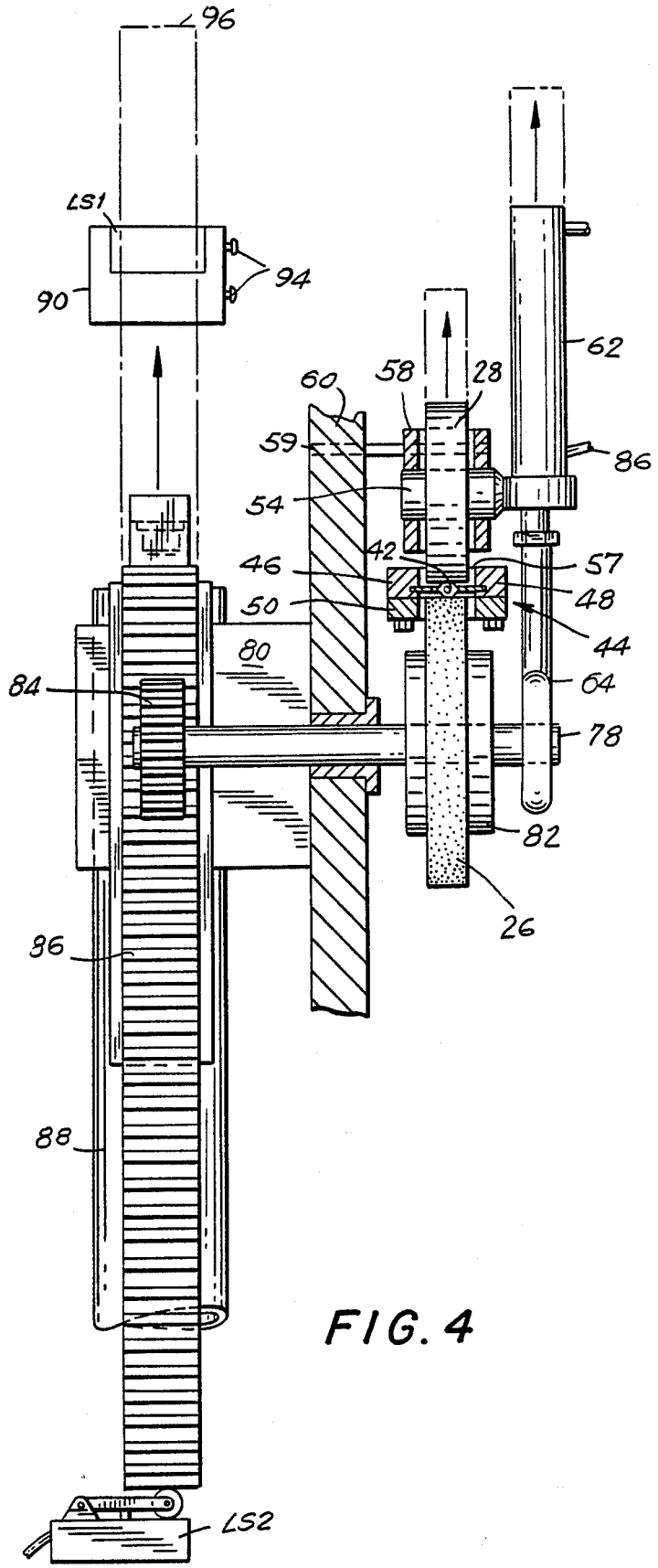
FIG. 4 is an enlarged view in partial cross-section, of the tie ribbon feed portion of the invention.
Figure 5:
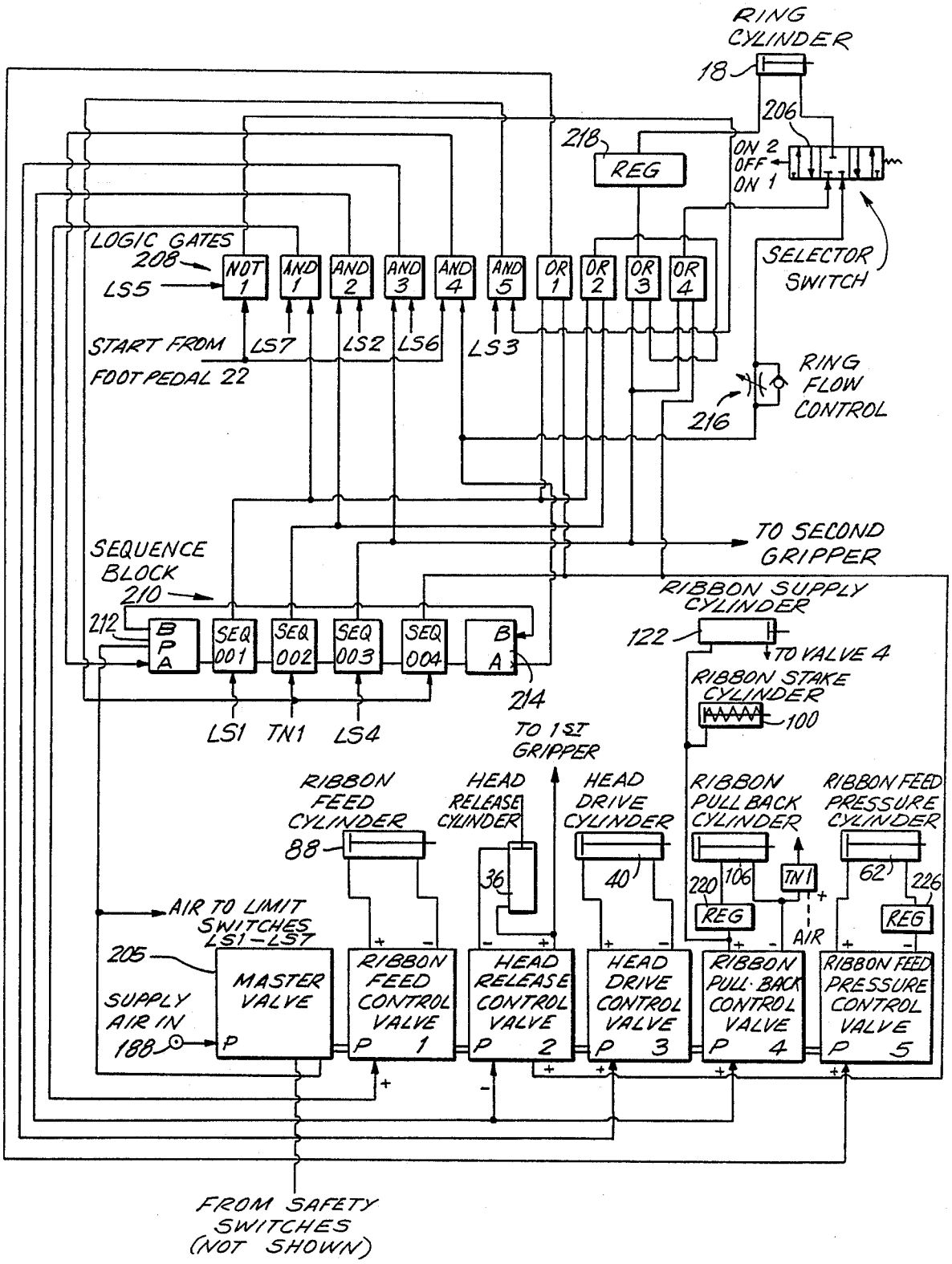
FIG. 5 is a schematic diagram of the pneumatic control system of the invention.

To advance tie wire 24 in guide channel 25, lower feed wheel 26 is turned by pinion 84 which is meshed with rack 86 (FIGS. 3 and 4). Rack 86, in turn, is driven upward by the application of air pressure to ribbon feed cylinder 88. When not being driven, ribbon feed cylinder 88 is returned to its starting position by return air pressure (FIG. 5). The amount of tie ribbon 24 which is fed around the product is controlled by setting the upward distance travelled by rack 86 by adjusting the position of a ribbon length limit switch block 90 on a limit switch support 92 (FIG. 3) along side of the path of feed drive rack 86. A limit switch LS1 is carried on limit switch block 90 and, when contacted by the upper end 96 of rack 86, signals for interruption of the flow of air pressure to ribbon feed cylinder 88 by the control circuit of FIG. 5.

As stated above, air pressure is supplied to ribbon feed cylinder 62 for driving it forward only during the time that lower ribbon feed wheel 26 is to be driven.

When the correct amount of tie ribbon has been looped around the product and when the leading end of the ribbon is in position to be clamped by the first gripper in twister head assembly 30, the driving of feed wheel 26 is stopped, and pressure is applied to tie ribbon stake cylinder 100 (FIG. 2). Actuation of ribbon stake cylinder 100 forces ribbon clamp block 102 against ribbon clamp 104, anchoring tie ribbon 24 firmly. At the same time, pressure is removed from idler wheel 28 by venting feed wheel cylinder 62.

Now the loop of tie ribbon which has been formed in guide rings 14 and 16 can be tightened about the product by supplying air pressure to a ribbon pullback cylinder 106 to force ribbon pullback rod 108 outward, thereby moving a tension arm 110. Tension arm 110 pivots about a pivot pin 112 which is supported in frame panel 60. From its resting position, shown in solid lines in FIG. 2, tension arm 110 is driven clockwise to the position 110', shown in dashed lines. Tension arm roller 114 is then positioned at the position 114', shown in dashed lines, and some of tie ribbon 24 has been withdrawn from the guide ring, causing the loop to close around the bundle. The position of the withdrawn tie ribbon 116' is shown in dashed lines between the lower end of feed chute 44 and a stationary cylindrical ribbon guide 118, which is bolted to frame panel 60. The amount of tie ribbon withdrawn from chute 44 and, hence, the tension applied to the bundled product by the movement of roller 114, is regulated by controlling the pressure which is applied to cylinder 106 by the pneumatic circuit of FIG. 5.

The tie ribbon feeder mechanism of the invention also includes means for accumulating a supply of tie ribbon 24 in a storage space whence it can later be drawn with little effort by the feed wheels. For this purpose, and while tie ribbon 24 is staked between block 102 and clamp 104, a feed arm 120 is rotated counterclockwise about a stationary pivot pin 112 by the application of air pressure to ribbon supply cylinder 122 to draw in feed arm connecting rod 124. The movement of connecting rod 124 is coupled by a clevis 126 to feed arm 120, which, in turn, moves feed arm roller 128 into the open mouth of a tie ribbon accumulator 98. Accumulator 98 is arcuate in configuration and provides a space between a pair of concentric arc-like surfaces in which the tie ribbon is temporarily stored. The tie ribbon is drawn into the accumulator space by a roller 128 whose surface lies across tie ribbon 124, and, which, when moved by feed arm 120, carries the tie ribbon between the respective curved surfaces of stationary ribbon guide block 130 and fixed ribbon guide roller 132, into the mouth of the accumulator. The amount of air supplied to feed arm actuator 122 is regulated so that feed arm roller 128 is moved along a predetermined arcuate distance into accumulator 98 so that a predetermined amount of tie ribbon is available in the accumulator at the start of each cycle for use in making the complete loop around the product.

To load the accumulator with tie ribbon, as shown in dashed lines 133', tie ribbon 24 is drawn past ribbon guide roller 132 from a supply spool 134. Supply spool 134 is supported on a spindle 136 which extends outwards from a spool support arm 138 which is fixed to frame panel 60. As depicted in FIGS. 1–3, after being unwound from supply spool 134, tie ribbon 24 passes first over the surface of a brake arm roller 145, and then, via ribbon guide 140 and a fixed roller 142, onto ribbon guide roller 132. A roller 145 is carried at the end of a brake arm 146 and the brake arm is pivotally mounted off center, relative to spool 134, at a pivot 148 as depicted in FIG. 3. A crank arm 150 extends at a right angle from brake arm 146 near pivot 148 and, at its outer end, is connected to a brake tension spring 144. A brake block 152 is carried on brake arm 146 and is adjustably positionable along the length thereof by means of adjustment holes 153. Brake block 152 bears upon the perimeter of tie ribbon supply spool 134. When the supply of tie ribbon 24 on reel 134 is drawn upon by the above-described movement of feed arm 120 and its roller 128, the force of the movement is transmitted around stationary feed roller 142 by the tie ribbon to brake arm roller 145. There, due to the resistance afforded by the inertia of supply spool 134 and by the action of brake block 152, the force applied by the tie ribbon to roller 145 causes brake arm 146 to rotate about brake arm pivot 148 and to lift brake block 152, which had until then been biased into contact by the force of brake tension spring 144, away from the peripheral braking surface of supply spool 134, allowing the supply spool to turn and release tie ribbon. When withdrawal of tie ribbon ceases, spring 144 acts upon crank arm 150 to move brake arm 146 in the reverse direction, causing brake block 152 to contact supply spool 134 and to stop rotation thereof.

Operation of the tie ribbon feed apparatus of the invention is controlled by air under pressure which is regulated by the control system depicted in FIG. 5, utilizing components which are variously positioned as shown in FIGS. 1–4. Air which is supplied to the system via an air filter and condensate remover 199 (FIGS. 2 and 3), is fed from an input terminal 188 (FIG. 5) to a master valve 205. From master valve 205, the compressed air passes internally to a series of control valves 1–5. Master valve 205 can be a single air pilot master valve (Part No. PVS-C2312297, Telemechanique, Inc., Westminster, Md.). Valves 1, and 3 to 5, can be single-air-pilot 4-way valves (part No. PVD-B1411287, Telemechanique, Inc., Westminster, Md.). Valve 2 can be a double-air-pilot 4-way valve (part No. PVD-B-1421287, Telemechanique, Inc., Westminster, Md.). Except for valve 2, all of the foregoing valves are of the spring return type. Air is supplied from master valve 205 to the control valves 1–5 when master valve 205 receives an appropriate signal from various safety switches (not shown) of the apparatus not illustrated. Each of control valves 1–5 is actuated by a pilot signal which is denoted by a plus sign (+) when the associated cylinder is to be driven forward and by a minus sign (−) if the associated cylinder is to be returned, as in the case of valve 2. The pilot signals are supplied to the respective pilot signal inputs P of the control valves from one of the logic gates which are depicted in block form at the top of FIG. 5. Each of control valves 1–5 is coupled to at least one pneumatic cylinder for actuating a portion of the apparatus of the invention. Ribbon feed control valve 1 receives a positive air signal from an AND gate AND1; head release control valve 2, the double pilot valve, receives a signal from gate AND2, on one pilot input and, via a sequencer 004, a signal from an AND gate AND5; head drive control valve 3 receives a signal from an AND gate AND3, ribbon pullback control valve 4 receives a signal from gate AND2, and ribbon feed pressure control valve 5 receives a positive air signal from an OR gate OR1. Control valve 1 provides air for driving ribbon feed cylinder 62; control valve 2 provides air for driving head release cylinder 36; control valve 3 supplies air for driving head drive cylinder 40; control valve 4 supplies air for actuating ribbon stake cylinder 100, ribbon pullback cylinder 106, and ribbon supply cylinder 122; and control valve 205 supplies air to ribbon feed pressure cylinder 62. Information feedback signals to the control system are obtained from a number of limit switches LS1–LS7, from a foot pedal 22, and from an exhaust sensor TN1.

Sequencer block 210 includes four sequencers designated 001 to 004, which are connected between an input block 212 and an output block 214. When sequencer input block 212 is enabled by the presence of air from master valve 205 on pilot input P, air is supplied from output block 214 to one input of gate AND4 which starts in the active condition. Air travels from gate AND4 to sequencer input block 212 when a Start Signal is received on the other input of gate AND4 from foot pedal 22. From input block 212, air is then supplied to a sequencer 001 which has an input from a limit switch LS1 and provides signals to a gate of each of gate AND1, gate OR1, and an OR gate OR2.

Sequencer 002 responds to a signal from an exhaust sensor TN1 when ribbon pullback cylinder 106 reaches the forward end of its travel, to provide an air signal to the other inputs of each of gate AND1, and gate OR2. Sequencer 002 is interconnected to sequencer 003 which responds to a signal from limit switch LS4 to provide a signal to an input of each of gate AND3, gate OR3 and gate OR4, as well as sending air to second tie ribbon gripper 34. Sequencer 003 is connected to a sequencer 004 which has the output of gate AND5 as an input, and provides signals to an input of gate OR1, an input of an OR gate OR5, and an air signal to the plus (+) pilot input of control valve 2. Sequencer output block 214 is connected to sequencer 004 and also receives, at its B input, an output from the B terminal of sequencer input block 212. The A output of output block 24 provides air to one input of gate AND4, and, via ring flow control 216 to one input of a ring cylinder selector switch 206.

Ring cylinder selector switch 206 comprises a 3-way valve arrangement having OFF, ON1, and ON2 positions. Selector switch 206 is located on the front panel of the apparatus (FIG. 1) and determines the open or closed position of product encircling ring portions 14, 16. When switch 206 is in the OFF position, the ring will remain closed throughout the machine cycle. When the switch is in the ON1 position, the ring is open for insertion of the product, closes when the foot switch is operated, reopens after the ribbon is twisted and cut, and remains open until the foot switch is depressed after insertion of the next product. When the switch is in the ON2 position, the ring is open for insertion of the product and closes when the foot switch is operated. The ring opens again after the ribbon has encircled the product but before the wrap tensioning sequence, and remains open until the foot switch is depressed after insertion of the next product. The last sequence allows a small coil to be drawn toward the machine during the ribbon tensioning sequence.

As shown in FIG. 5, air from selector switch 206 is supplied to the side of ring cylinder 18 which drives the ring to the closed position, while air from gate OR3 is supplied, via a ring pressure control regulator 218, to the other side of ring cylinder 18 for opening the ring. The rate of closure of ring cylinder 18 is established by ring flow control 216 which provides for unchecked flow of air from the A output of sequencer output block 214 to the ring cylinder via selector switch 206 for opening the ring, and which restricts the flow of air from ring cylinder 18 via selector switch 206 when the ring is being closed.

To complete the description of the connections to the logic gates, the output of gate OR2 is coupled to one input of gate OR3. A NOT gate NOT1 has air signals from a limit switch LS5 (FIG. 3) when head release cylinder 36 is in the locking position, and from foot pedal 22 as inputs. The output of gate NOT1 is coupled to one input of gate AND5. The other input of gate AND5 receives an air signal from a limit switch LS3 (FIG. 3) upon return of head drive cylinder 40 to its starting position, and transmits a signal to sequencer 004 upon the concurrence of the input signals. Gate AND1, in addition to the signal on one input from sequencer 001, receives a signal from a limit switch LS7 on the other input when ring cylinder 18 has been fully actuated. Gate AND2, in addition to a signal on one input from sequencer 002, has a signal on the other input from a limit switch LS2 (FIG. 3) when ribbon feed cylinder 88 is fully returned, and provides an output upon coincidence of these signals to control valve 4. In addition to the input signal from sequencer 003 on one input, gate AND3 has a signal from a limit switch LS6 on the other input when ribbon pullback cylinder 4 is in its starting position, and provides, upon coincidence of these signals, a signal to control valve 3.

The logic gates, the sequencer components, and the threshold sensor can b those supplied by Telemechanique, Md. having the following part designations: OR-gate PLK-11, AND gate PLL-A11, NOT gate PLN-C12, sequencer PSM-A12, and threshold sensor PWS-C3148.

Air is input to the system at a pressure of between 50 and 80 psi, being supplied to particular drive cylinders through adjustable regulators. The various regulators are accessible to the operator on the front panel (FIG. 1) and on a side panel (FIG. 2), along with associated gauges for showing the pressure which is being supplied by each regulator. The front panel includes a gauge 215 for the line air pressure, the control knob of ring cylinder selector switch 206, a gauge 219 for ribbon pullback pressure, and the control knob of ribbon pullback air pressure regulator 220. A side panel (FIG. 2) includes a ring air pressure gauge 217, the control knob of ring air pressure regulator 218, gripper air pressure gauge 223, gripper air pressure regulator knob 224 and an air pressure gauge 225 for measuring the pressure set by the ribbon feed pressure regulator 226. The air pressure regulators can be those supplied by the C. A. Norgren Co., Littleton, Colo. part No. R07-100-RNKA.

In operation, the cabinet doors must be closed so as to actuate various door limit switches (not shown), sending a signal to master control valve 205 and enabling supply of air under pressure from input 188 to limit switches LS1 TO LS7, to control valves 1–5, to sequencer input block 212 and to exhaust sensor TN1. The various pressure settings for the regulator valves which control the amount of pressure to be applied by cylinder 62 to feed wheels 26 and 28 by cylinder 62, the tension to be applied when the tie ribbon is pulled back by the application of air pressure to ribbon pullback cylinder 106, etc., having each been previously determined and set into the appropriate regulator, the operator places a bundle of produce within split ring parts 14 and 16, and depresses foot pedal 22. If ring selector switch 206 has been set at one of the ON positions, actuation of foot pedal valve 22 sends a signal to gate NOT1 which shuts off the supply of air to gate NOT1 from limit switch LS5, preventing repetition of the operation by cutting off the signal from gate NOT1 to gate AND5. The signal from foot pedal valve 22 is also transmitted to one input of gate AND4, there being an "A" signal from output block 214 of sequencer block 210 on the other input of gate AND4. Gate AND4 transmits air to the A port on input block 212 of the sequencer block, activating sequencer 001.

Sequencer 001 thereupon sends air, via gates OR2 and OR3, to the back port of ring cylinder 18, actuating the cylinder and closing upper ring part 16 onto lower ring part 14. At the same time, signals are sent from sequencer 001 to one side of each of gate AND1, and gate OR1. Gate OR1 passes a signal to the pilot port of control valve 5. Control valve 5 opens and applies pressure to ribbon feed pressure cylinder 122, urging idler wheel 28 towards ribbon feed wheel 26, gripping tie ribbon 24. When ring cylinder 18 is fully extended, limit switch LS7 (FIGS. 2,3) is actuated, sending a signal to gate AND1. There being now signals on both inputs, gate AND1 sends signals to the P input of ribbon feed control valve 1, via gate OR1 to the P input of ribbon feed pressure control valve 5, and, via gates OR2 and OR3 and regulator 218, to ring cylinder 18. Thus, while ring cylinder 18 is maintained in the closed position, control valve 5 feeds air at a predetermined minimum pressure to feed pressure cylinder 62 to bring idler wheel 26 against the tie ribbon, and control valve 1 feeds air to put a predetermined pressure in ribbon feed cylinder 88, rotating feed wheel 28. When ribbon feed cylinder 62 has reached the predetermined extension, limit switch LS1 (FIG. 3) is actuated, sending an air feedback signal to sequencer 001 which turns on sequencer 02, and resets sequencer 001.

Sequencer 002 now transmits an air signal to gate AND2, and to gate OR2 for maintaining pressure on ring cylinder 18. At the same time, the departure of the pilot signal from spring-return control valve 1, due to the shift from sequencer 001 to sequencer 002, causes control valve 1 to supply air to the reverse side of ribbon feed cylinder 88. When ribbon feed cylinder 88 is fully restored to its starting position, a limit switch LS2 (FIG. 3) is actuated, and an air signal is sent to the other input of gate AND2. Since there are now signals present at both inputs to gate AND2, a signal is passed therefrom to the minus (−) pilot input of head release control valve 2, withdrawing head release cylinder 36 and freeing the head drive for operation. Control valve 2 also sends air to first gripper 32, causing the leading end of tie ribbon 24 to be clamped in twist head 30 (FIG. 1). Finally, a signal from gate AND2 is transmitted to the pilot input of ribbon pull-back control valve 4 which transmits air via regulator 220 to actuate ribbon pull-back cylinder 106, to ribbon stake cylinder 100, and ribbon supply cylinder 122. Regulator 220, as described above, establishes the tension used in tightening tie ribbon 24 about the product. When ribbon pull-back cylinder 106 has reached its full extension, depending upon the balance of the regulated air pressure in the cylinder and the tension in tie ribbon 24, the absence of air flow from cylinder 106 is detected by exhaust sensor TN1 which sends a feed-back signal to the bottom port of sequencer 002, actuating sequencer 003, and resetting sequencer 002.

Upon actuation, sequencer 003 sends air to second gripper 34 which clamps the uncut tie ribbon 24 in twist head 30 and, at the same time, sends air signals to one input of each of gate AND3 and of gates OR3 and OR4. Since sequencer 002 is off, gate AND2 no longer supplies air to the pilot port of ribbon pull-back control valve 4 and air is supplied for retraction of ribbon pull-back cylinder 106 and ribbon supply cylinder 122 to their starting positions. Ribbon stake cylinder 100 is driven to its open position by a return spring. When a signal from limit switch LS6 (FIG. 2), indicating that ribbon pull-back cylinder 106 has returned to its original position, is transmitted to gate AND3, the concurrent presence of the air signal from sequencer 003 causes air to be transmitted by gate AND3 to the pilot input of head drive control valve 3, sending head drive cylinder 40 forward to rotate the twist head and to cut the ribbon. A signal from sequencer 003 to gate OR3 causes the ring to stay closed when selector switch 206 is set in the ON1 position. Should selector switch 206 be set in the ON2 position at this point in the sequence, the ring will be opened by the passage of air to the return side of ring cylinder 18 through gate OR4 and selector switch 206. When head drive cylinder 40 has reached its full extension, limit switch LS4 (FIG. 3) is actuated, and an air signal is transmitted to the bottom of sequencer 003, which steps the sequencer block over to sequencer 004, and resets sequencer 003.

Air output by actuated sequencer 004 is fed via gate OR1 to ribbon feed pressure control valve 5, and to the plus (+) pilot input of head release control valve 2, sending air to extend drive head release cylinder 36 to again lock twist head 30 against rotation. Air is also fed to gate 4 for retaining the ring in the open position. While this is taking place, the absence of a signal to head drive control valve 3 causes air to be supplied to the return side of head drive cylinder 40 which returns to its starting point. At this point, both limit switches LS3 and LS5 are actuated, signalling the returns of head drive cylinder 40 and of head release cylinder 36 to their respective starting positions. Limit switch LS3 thus sends a signal to one side of gate AND5 and limit switch LS5 sends a signal to one side of gate NOT1. If foot pedal 22 is depressed at this time, the signal from limit switch LS5 cannot pass through gate NOT1 to gate AND5, the circuit to sequencer 004 through gate AND5 will not be complete; restarting of the machine is thus prevented. If foot pedal 22 has been released, air from limit switch LS5 passes to the right side of gate AND5 which, being completed, sends air to the input of sequencer 004. Sequencer 004 remains active, and an air signal is present on gate AND4, putting the machine in a state of rest and in condition for restarting by a signal from foot pedal 22.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for use with a guide and a twist head for feeding a tie ribbon from a source of tie ribbon and for tightening the tie ribbon about a product, the twist head having a gripper for clamping an end of the tie ribbon, the apparatus comprising:

feed means for feeding tie ribbon in a feed direction via the guide to the gripper;

pressure means coupled to the feed means for causing the feed means to grip the tie ribbon when the feed means is feeding the ribbon and for causing the feed means to release the tie ribbon when the tie ribbon has been clamped in the gripper;

staking means for immobilizing the tie ribbon after the tie ribbon has been clamped in the twist head, the staking means being located on the path of the tie ribbon between the source and the guide; and pull-back means located adjacent to the path of the tie ribbon for engaging and forcibly moving a portion of the tie ribbon out of the path by applying controlled tension to the ribbon in a direction substantially opposite the feed direction without creating substantial drag in the tie ribbon, the pull-back means including a surface which engages the tie ribbon, means for moving the surface through the path of the ribbon to pull back the tie ribbon, the means for moving the surface including a lever arm which is mounted for motion about a pivot spaced from the surface;

whereby the tie ribbon is pulled back and tightened around the product.

2. The apparatus of claim 1 wherein the feed means comprises an idler wheel and a driver wheel which are moved, relative to one another, by the feed pressure means.

3. The apparatus of claim 2 and further comprising:

means coupled to the driver wheel for turning the driver wheel to feed the tie ribbon.

4. The apparatus of claim 1 wherein the surface which engages the tie ribbon comprises a roller.

5. The apparatus of claim 1 wherein the means for moving the surface which contacts the tie ribbon comprises a pneumatic drive cylinder, and further comprising:

a source of air under pressure; and regulator means coupling air from the source of air under pressure to the pneumatic drive cylinder, the regulator means setting the level of pressure which is fed to the cylinder so as to control the level of tension in the tie ribbon around the product.

6. The apparatus of claim 1 wherein the force applied to the pull-back means establishes the level of tension in the tie ribbon around the bundle.

7. The apparatus of claim 1 and further comprising:

accumulator means from which the tie ribbon can be withdrawn by the feed means without creating substantial tension in the tie ribbon; and means for moving tie ribbon into the accumulator means from the source of tie ribbon.

8. The apparatus of claim 7 wherein the accumulator means comprises an accumulator space defined by two parallel surfaces in which the tie ribbon can be stored for withdrawal.

9. The apparatus of claim 7 and further comprising:

means adjacent to the accumulator means for moving tie ribbon into the accumulator means from a source of tie ribbon.

10. The apparatus of claim 7 wherein the source of tie ribbon comprises a supply reel which is supported for rotary motion adjacent to the accumulator means and further comprising:

brake means coupled to the supply reel, the brake means responding to tension in the tie ribbon when tie ribbon is being withdrawn, to allow the supply reel to turn.

11. The apparatus of claim 10 wherein the supply reel is supported on an axis and the brake means further comprises:

a brake arm pivoted off-center, relative to the axis of the supply reel;

a brake surface carried on the brake arm, the brake surface being positioned to brake the supply reel when in contact therewith;

spring means coupled to the brake arm for urging the brake surface into contact with the supply reel; and pulley means on the end of the brake arm, the tie ribbon being passed over the pulley means en route from the supply reel to the means for moving tie ribbon into the accumulator lever arm so that, when tie ribbon is moved into the accumulator, the brake surface is moved out of contact with the supply reel.

12. The apparatus of claim 7 and further comprising:

driver means for driving the feed means;

control means for actuating the pressure means to cause the feed means to grip the tie ribbon; and means for actuating the driver means while the pressure means is actuated.

13. The apparatus of claim 12 and further comprising:

means responsive to completion of driving of the feed means and deactivation of the pressure means for actuating the pull-back means, the staking means, and the means for moving tie ribbon into the accumulator.

14. The apparatus of claim 1, and further comprising:

driver means for driving the feed means;

control means responsive to a control signal for actuating the pressure means to cause the feed means to grip the tie ribbon; and means for actuating the driver means while the pressure means is actuated.

15. The apparatus of claim 14 wherein the control means for actuates the staking means and the pull-back means when driving of the feed means has been completed and when the pressure means is no longer actuated.

16. The apparatus of claim 1 wherein the twist head comprises an additional gripper for clamping the uncut end of the tie ribbon after the tie ribbon has been fed around the product, and further comprising:

stop means on the additional gripper for limiting travel of the tie ribbon past the first named gripper.

17. An apparatus for use with a guide and a twist head for feeding a tie ribbon from a source of tie ribbon and for tightening the tie ribbon about a product, the twist head having a gripper for clamping an end of the tie ribbon, the apparatus comprising:

feed means for feeding tie ribbon in a feed direction via the guide to the gripper;

pressure means coupled to the feed means for causing the feed means to grip the tie ribbon when the feed means is feeding the ribbon and for causing the feed means to release the tie ribbon when the tie ribbon has been clamped in the gripper;

staking means for immobilizing the tie ribbon after the tie ribbon has been clamped in the twist head, the staking means being located on the path of the tie ribbon between the source and the guide;

pull-back means located adjacent to the path of the tie ribbon for engaging and forcibly moving a portion of the tie ribbon out of the path by applying controlled tension to the ribbon in a direction substantially opposite the feed direction, whereby the tie ribbon is pulled back and tightened around the product;

accumulator means from which the tie ribbon can be withdrawn by the feed means without creating substantial tension in the tie ribbon, the accumulator means comprising an accumulator space defined by two parallel surfaces in which the tie ribbon can be stored for withdrawal; and means for moving tie ribbon into the accumulator means from the source of tie ribbon, the surfaces of the accumulator means being concentric arcs, the means for moving the tie ribbon into the accumulator means further comprising:

lever arm means pivoted substantially at the center of the concentric arcs for moving the tie ribbon into the accumulator space, the lever arm means comprising a surface which engages the tie ribbon.

18. The apparatus of claim 17 wherein the surface of the lever are means which engages the tie ribbon comprises a roller.

19. An apparatus for use with a guide and a twist head for feeding a tie ribbon from a source of tie ribbon and for tightening the tie ribbon about a product, the twist head having a gripper for clamping an end of the tie ribbon, the apparatus comprising:

feed means for feeding tie ribbon via the guide to the grippers;

an accumulator defined by two parallel surfaces in which the tie ribbon can be stored for withdrawal by the feed means without creating substantial tension in the tie ribbon, the two parallel surfaces being concentric arcs; and lever arm means pivoted substantially at the center of the concentric arc for moving the tie ribbon into the accumulator space, the lever arm means having a surface which engages the tie ribbon from the source of tie ribbon.

* * * * *